US005575938A

United States Patent [19]

Ono

[11] Patent Number: 5,575,938

[45] Date of Patent: Nov. 19, 1996

[54] FORM PANEL

[76] Inventor: Tatsuo Ono, 5-20-13, Matsugaoka, Funabashi, Chiba, Japan

[21] Appl. No.: 140,765

[22] Filed: Oct. 21, 1993

[30] Foreign Application Priority Data

Oct. 28, 1992 [JP] Japan ..... 4-312988

[51] Int. Cl.[6] ..... E04G 9/10; E04G 17/00

[52] U.S. Cl. ..... 249/189; 249/210; 249/219.1

[58] Field of Search ..... 249/189, 210, 249/219.1

[56] References Cited

U.S. PATENT DOCUMENTS

| | | | |
|---|---|---|---|
| 3,488,028 | 1/1970 | Verburgh | 249/189 |
| 3,791,615 | 2/1974 | Ewing | 249/189 |
| 3,899,155 | 8/1975 | Ward | 249/189 |
| 4,076,206 | 2/1978 | Marseillan | 249/189 |
| 5,102,092 | 4/1992 | Salas | 249/189 |
| 5,160,640 | 11/1992 | Badsteiber | 249/189 |

FOREIGN PATENT DOCUMENTS 63-16766 5/1988 Japan .

*Primary Examiner*—James P. Mackey
*Attorney, Agent, or Firm*—McGlew and Tuttle

[57] ABSTRACT

A form panel which facilitates the assembly and disassembly of the form, thereby insuring high economics and working efficiency. The form panel includes a reinforcing frame body (3) secured on a flat board (2) and on the back surface of the flat board, and flanges (29, 29) provided on the back part of the frame body.

7 Claims, 7 Drawing Sheets

FORM PANEL

BACKGROUND OF THE INVENTION

The present invention relates to a form panel for supporting concrete placed when a structure body is formed in construction and civil engineering works.

The form panel is used to support concrete that has been placed in civil engineering works for the construction of a tunnel or other and the formation of such structural bodies as wall, beam, ceiling, floor, pillar, etc. of a building.

This form panel includes plywood and a reinforcing frame body fixed to the plywood as has been disclosed in for example Japanese Utility Model Publication No. Sho 63-16766, and is fastened with clamps when used. This form panel is supported with vertical and horizontal end rails on the back side.

Furthermore, on the side part, and in the lower part, of the form panel are provided scaffoldings separately from the form panel, so that concrete placing and form panel assembly and disassembly works are carried out by utilizing these scaffoldings.

Since the independent end rails are employed to support this form panel in order to receive a load from concrete when the aforesaid form panel is used, the form panel comprises many component parts, which are hard to assemble and disassemble, and, therefore, is inferior in economics and working efficiency.

Furthermore, it is wasteful to separately provide the scaffoldings for concrete placing and form panel assembly and disassembly without connection with the form panel.

SUMMARY OF THE INVENTION

It is, therefore, an object of the present invention to provide a form panel which facilitates the assembly and disassembly of the form panel to insure high economics and working efficiency.

To accomplish the above object, the form panel of the present invention comprises a flat board, a reinforcing frame body fixed on the back of the flat board, and flanges provided on the back section of the frame body.

According to the form panel of the aforesaid constitution, the flat board and the reinforcing frame body set up in an area where concrete will be placed can be jointed to the scaffolding framing and other supporting posts through braces locked to the flanges, so that the form panel can be assembled or disassembled at the same time and furthermore can bear up a load from concrete on this scaffolding framing and post side.

DETAILED DESCRIPTION OF THE PREFERRED EMBODIMENT

Hereinafter an exemplary embodiment of a form panel according to the present invention will be explained with reference to the accompanying drawings.

Figure 1:
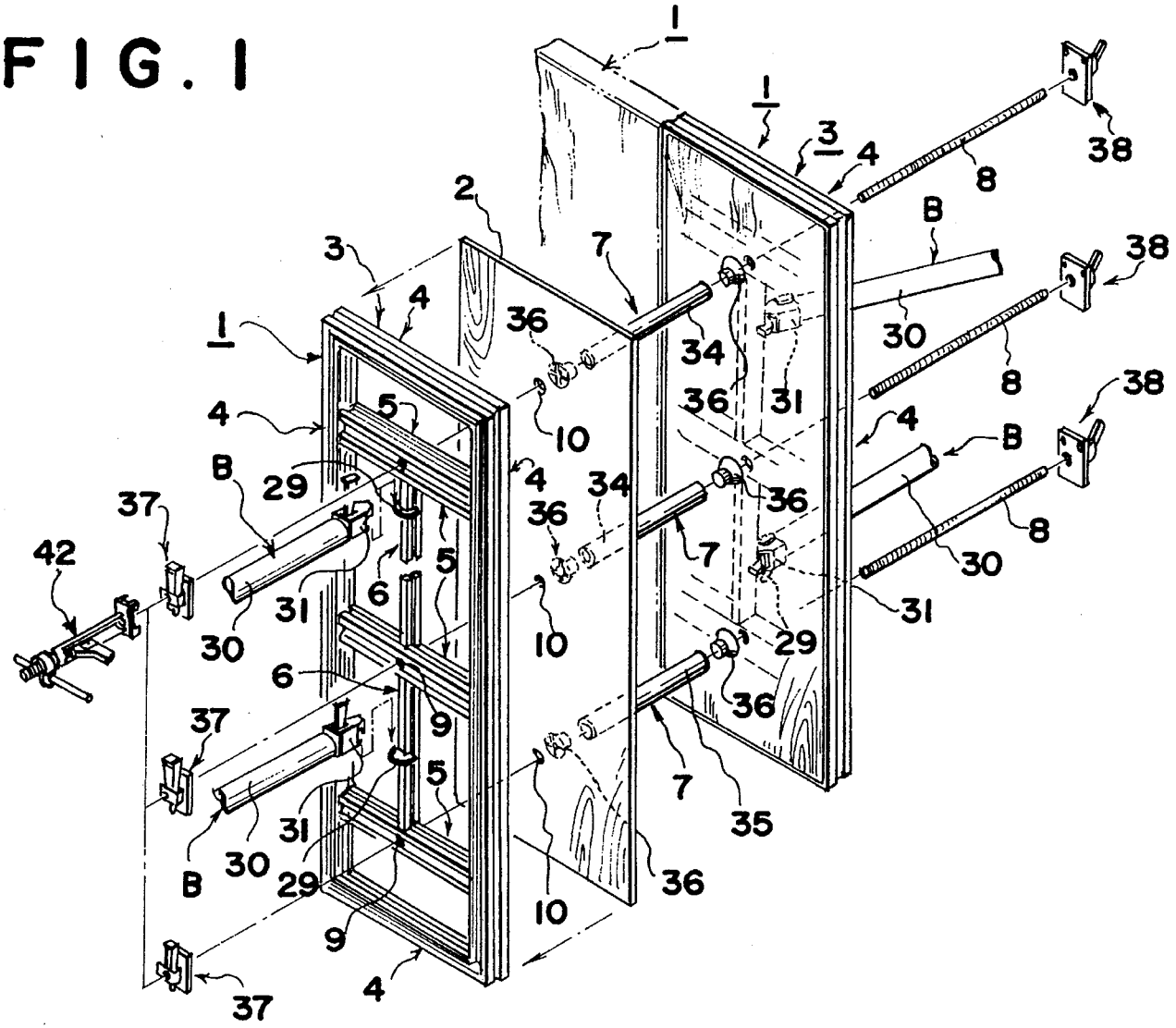
FIG. 1 is a schematic view showing one embodiment of a form panel according to the present invention.

As shown in the embodiment in FIG. 1, a frame panel 1 comprises a flat board 2 consisting of sheets of plywood, a reinforcing frame body 3 fixed on the back of the flat board 2, and flanges provided on the back section of the frame body 3.

The frame body 3 consists of an outside frame 4 which is rectangular in shape on the whole, one or a plurality of horizontal rails 5 provided in a horizontal direction inside of the outside frame 4, and a vertical rail 6 provided in a vertical direction between the horizontal rails 5.

Holes 9 and 10 for inserting bolts 8 of clamps 7 are provided in the center of the horizontal rails 5 and in the flat board 2 in positions corresponding to the holes in the center of the horizontal rails 5.

Figure 2:
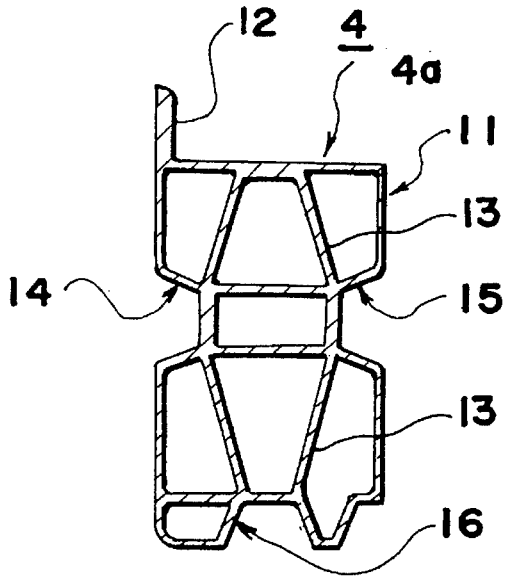
FIG. 2 is a sectional view of an outside frame.

The outside frame 4 is provided with a hollow profile **4*a* produced of a long aluminum or other shape material cut to an optional length and a support portion 12 protruding horizontally at one end of the profile 4*a* for supporting the flat board as shown in FIG. 2**.

The interior of the profile **4*a* is reinforced with a beam 13, and has V- or U-sectioned grooves 14, 15 and 16 formed along the axial direction and tapered along the inner periphery at the upper and lower parts of the outside surface and on the back surface, thereby forming raised and depressed portions, so that the raised portion will stiffen the profile 4*a***.

Figure 3:
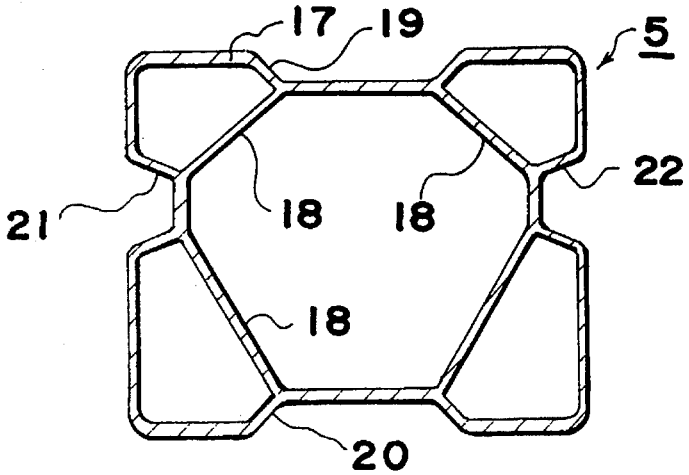
FIG. 3 is a sectional view of a horizontal frame.

The horizontal rail 5, as shown in FIG. 3, similarly has a hollow profile 17 and a beam 18 provided inside of this profile 17, and also has U-sectioned grooves 19, 20 and 21, 22 formed in the axial direction, facing radially outward, vertically and horizontally along the outer periphery of the profile 17.

Figure 4:
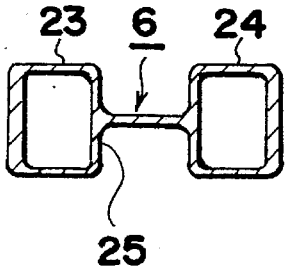
FIG. 4 is a sectional view of a vertical frame.

Furthermore the vertical rail 6, as shown in FIG. 4, is provided with a hollow profile 23 and a pair of U-sectioned grooves 24 and 25 formed along the axial direction, facing radially outward, on the right and left of the profile 23.

Therefore, raised and depressed portions are formed along the outer periphery by these grooves 24 and 25, the raised portion stiffening the whole part.

The grooves 14, 15 and 16 of the outside frame 4, the grooves 19, 20, 21 and 22 of the horizontal rail, and the grooves 24 and 25 of the vertical rail 6 are so designed as to allow the insertion of fingers from the upper and lower back sections or from right and left to grasp the form panel 1 for the purpose of carrying the form panel 1 by hand.

Furthermore, there will be used a plurality of form panels 1, which will be connected vertically or horizontally in accordance with the size of a structure body to be built. At this time, as described later by referring to FIGS. 5 and 6, adjacent form panels 1, 1 will be jointed with clamps.

Since a hook part such as the pawl of the clamp is set in the groove 15 of the outside frame 4, the form panels 1, 1 can be clamped firmly without biting of the hook part into the panel. Consequently there will be left no clearance between the adjacent form panels, thereby preventing the dislocation of the form panels.

On the back of the form panel 1, as shown in FIG. 1, a support member B is provided to hold the form panel 1 upright and to press the form panel 1 against the structure body side of concrete placed to set.

This support member B consists of a flange 29 connected to the vertical rail 6 of the reinforcing frame body 3, and a brace 30 made of a horizontal or diagonal member removably connected to this flange 29.

Figure 7:
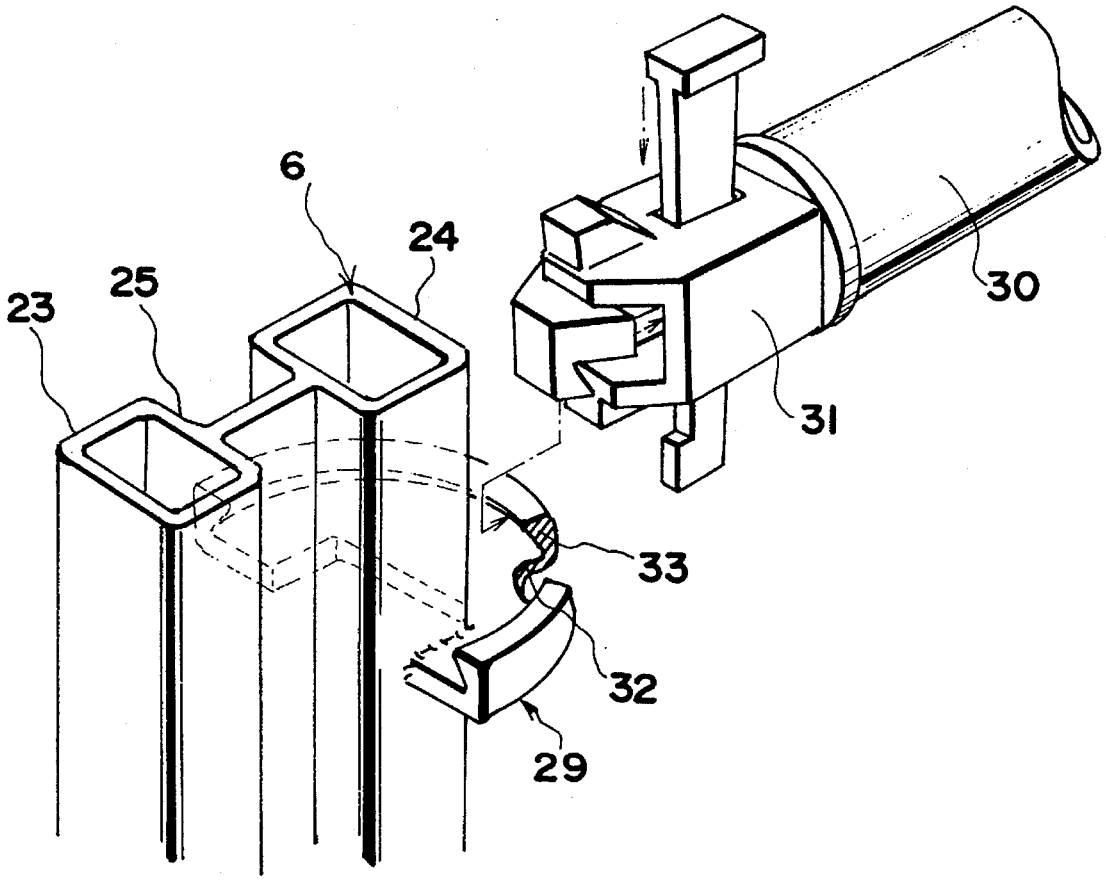
FIG. 7 is a perspective view, partly broken, of one embodiment of a flange and a frame.

The flange 29, as shown in for example FIG. 7, consists of a semi-circular frame body 32 fixed on the vertical rail 6, and a hook 33 which is a hooking part formed in the outer periphery along the circumferential direction.

The flange 29 may be a semi-circular porous dish plate, a semi-circular ring, or a frame body sectioned in a form of half cup so long as the brace 30 can be connected thereto.

The brace 30 has a pawl, hook, or shoe 31 to be engaged with the flange 29, and is connected in one direction or in a plurality of radial directions through the pawl, hook or shoe 31.

This brace 30 is connected to a post, scaffolding, or other set upright on the ground.

The post is used to support a form placed in a ceiling, a floor, or the upper arch part of a tunnel, and the scaffolding frame is employed in concrete placing work, and in form assembling and disassembling work.

Therefore, the form panel 1 is supported by the support member B consisting of the flange 29 and the brace 30, and is connected to the support posts and scaffolding frame, so that the form panel 1 can be set to these posts simultaneously with the installation of the scaffolding frame when concrete is placed, thus bearing up the load from the placed concrete by the posts and the scaffolding frame through the support member B.

Consequently the use of independent horizontal end rails and vertical end rail for holding the form panel 1 is not necessitated, thereby decreasing the number of component parts.

The brace 30, being connected to the flange 29 fixed in a predetermined position, can easily be positioned and installed to, and removed from, the flange 29.

The clamp 7 is located between the form panels 3, 3 facing to each other, and consists of a pipe 34 buried under concrete, cones 36, 36 to be inserted into both ends of the pipe 34, a bolt 8 to be inserted into the pipe 34 and the cones 36, 36, and fastening members 37 and 38 connected on both sides of the bolt 8 to tighten the form panels 1, 1 from both guides.

In other applications, the flange 29 is installed to the form panels 1, 1, whereby enabling firm fastening of the form panels 1, 1 to other supports and scaffolding frame through the support member B. In this case, the form panels 1, 1 are usable without the clamp 7, the bolt 8, and the fastening members 37 and 38.

A reference numeral 42 refers to a jig to be inserted over the bolt 8 for tightening the bolt 8 from outside.

Figure 5:
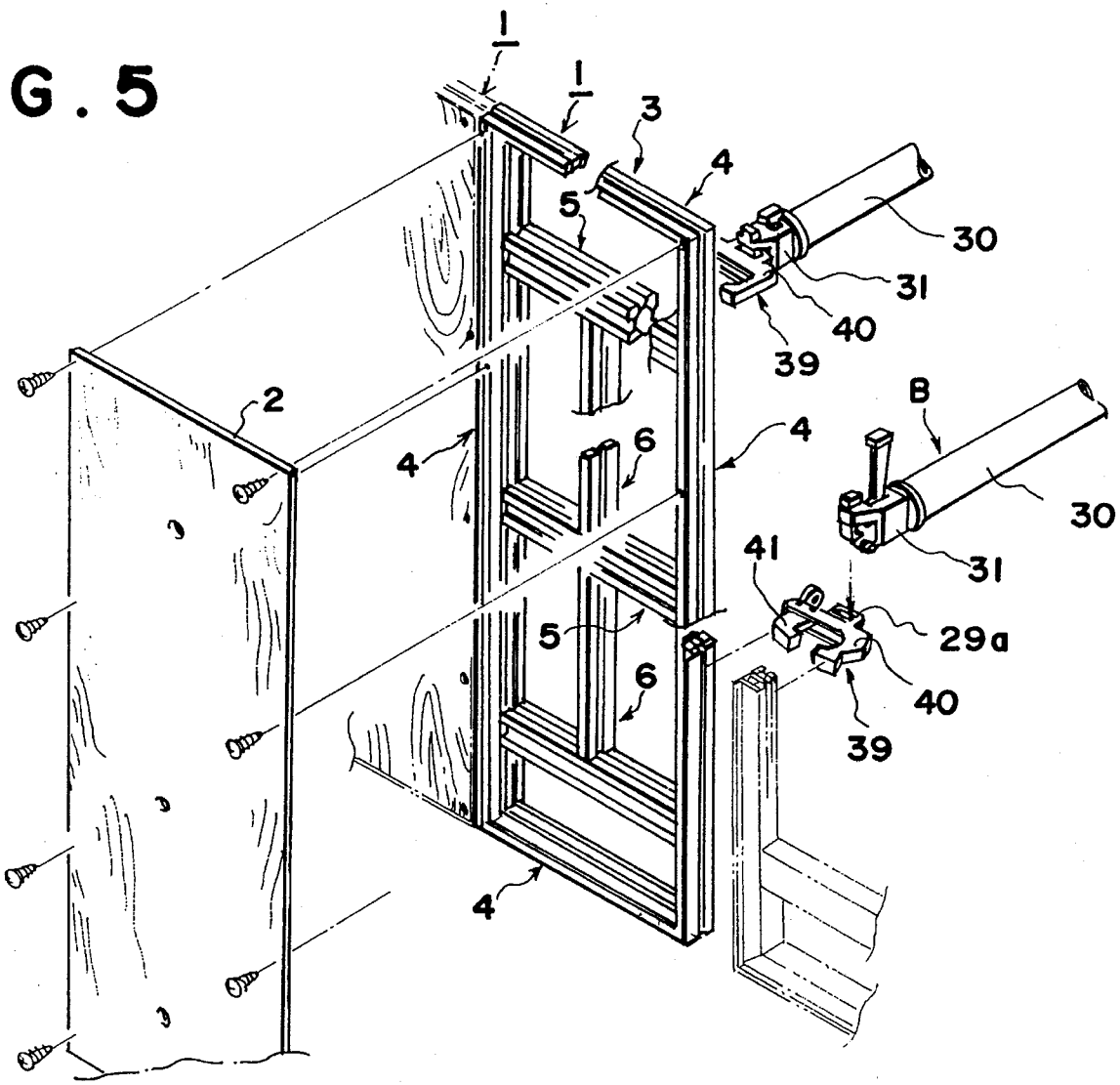
FIG. 5 is an exploded perspective view of another embodiment of the form panel according to the present invention.
Figure 6:
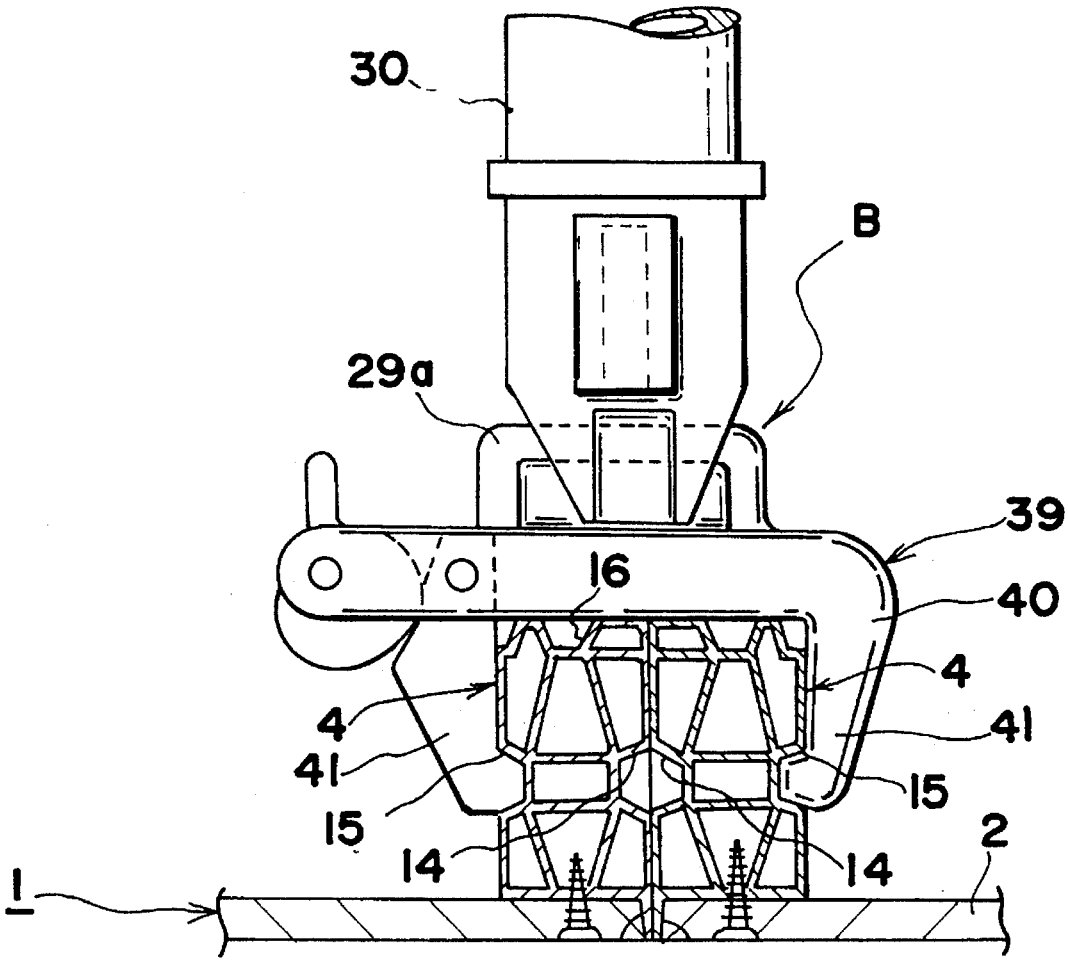
FIG. 6 is a transverse sectional plan view showing a clamp mounted for joining the form panel in a horizontal direction.

FIGS. 5 and 6 show another embodiment of the present invention.

This serves to connect two adjacent form panels 1, 1 and to support each of the form panels 1, 1 when setting up a plurality of form panels 1, 1 in horizontal and vertical directions.

This is composed of a clamp 39 to be removably connected to the grooves 15, 15 of the outside frames 4, 4 of the form panels 1, 1, a flange 29a connected by the clamp 39, and a brace 30 removably connected to the flange 29*a*.

The clamp 39 is composed of a hook-shaped body 40 and hooks 41, 41 rotatably connected to this body 40, and the flange 29*a* is connected on the back of the body 40.

Therefore, when the body 40 of the clamp 39 and the hooks 41, 41 are tightened, biting into the grooves 15, 15 of the outside frames 4, 4, the form panels 1, 1 are horizontally connected through this clamp 39, thus forming a wide panel. When the form panels 3, 3 are jointed in a vertical direction, the clamp 39 is engaged with the grooves 21 and 22 of the horizontal rails 5, 5.

Furthermore, each of the form panels 1, 1 is connected to an external supporting post and a scaffolding frame through the brace 30 connected to the flange 29*a*.

Other constitutions, functions, and effects are the same as those of the embodiment shown in FIG. 1.

Figure 8:
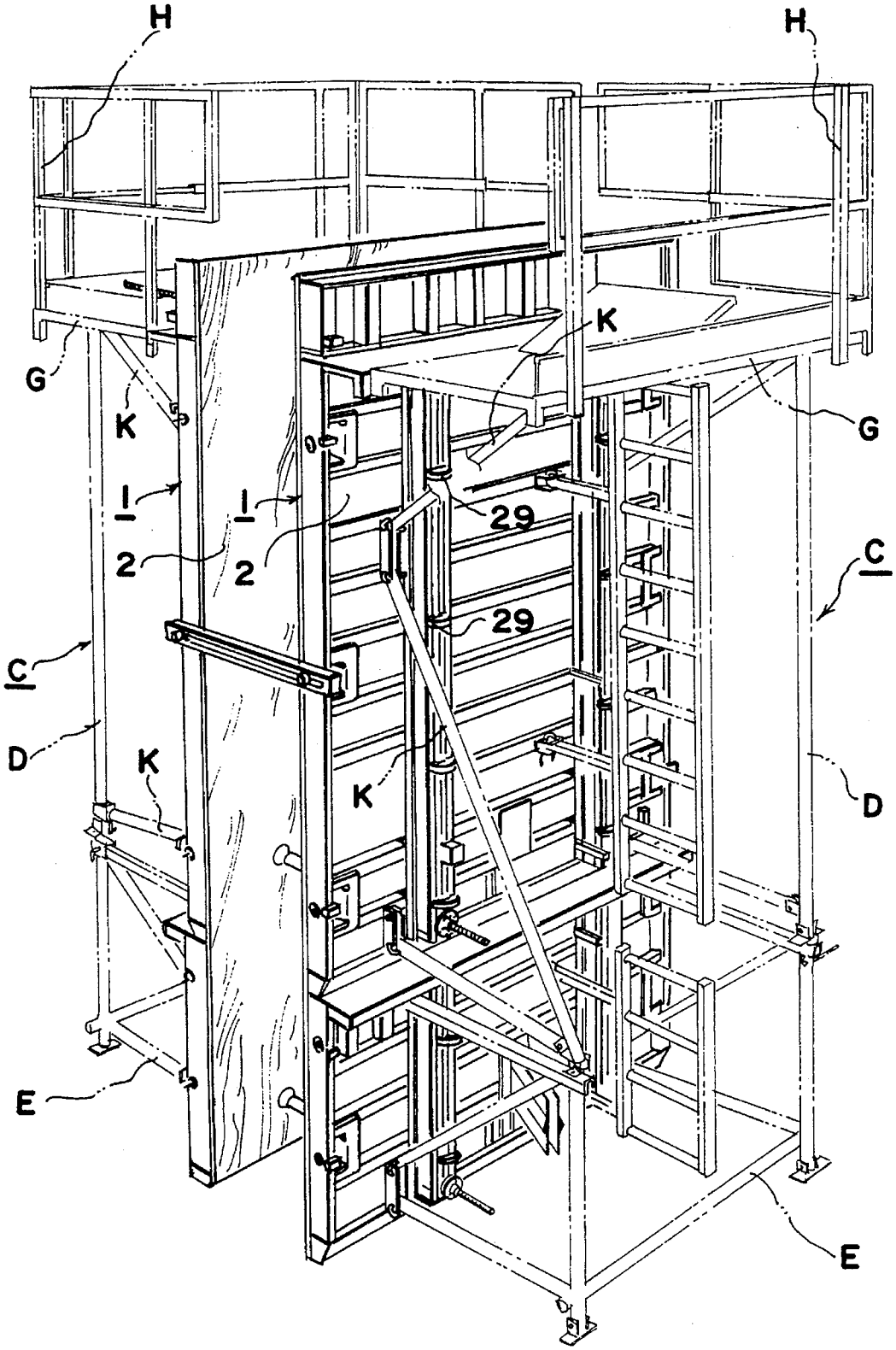
FIG. 8 is a perspective view showing an example of the form panel connected to a scaffolding framing.

FIG. 8 shows an embodiment in which the form panels 1, 1 of another embodiment according to the present invention are connected to a scaffolding.

That is, the form panels 1, 1 are connected to a scaffolding C through support members K, K, and the flange 29 is connected to another support post through a brace. The scaffolding C has posts D and E, a ladder F, a scaffolding board G provided on the upper part of the post D, and a handrail H.

The form panels 1, 1 are simultaneously set up or disassembled in a structure body molding position by the use of the scaffolding C. Furthermore, concrete placing and the installation and removal of upper supports on the other ceiling side, floor side, etc. can be performed by utilizing the scaffolding G.

Figure 9:
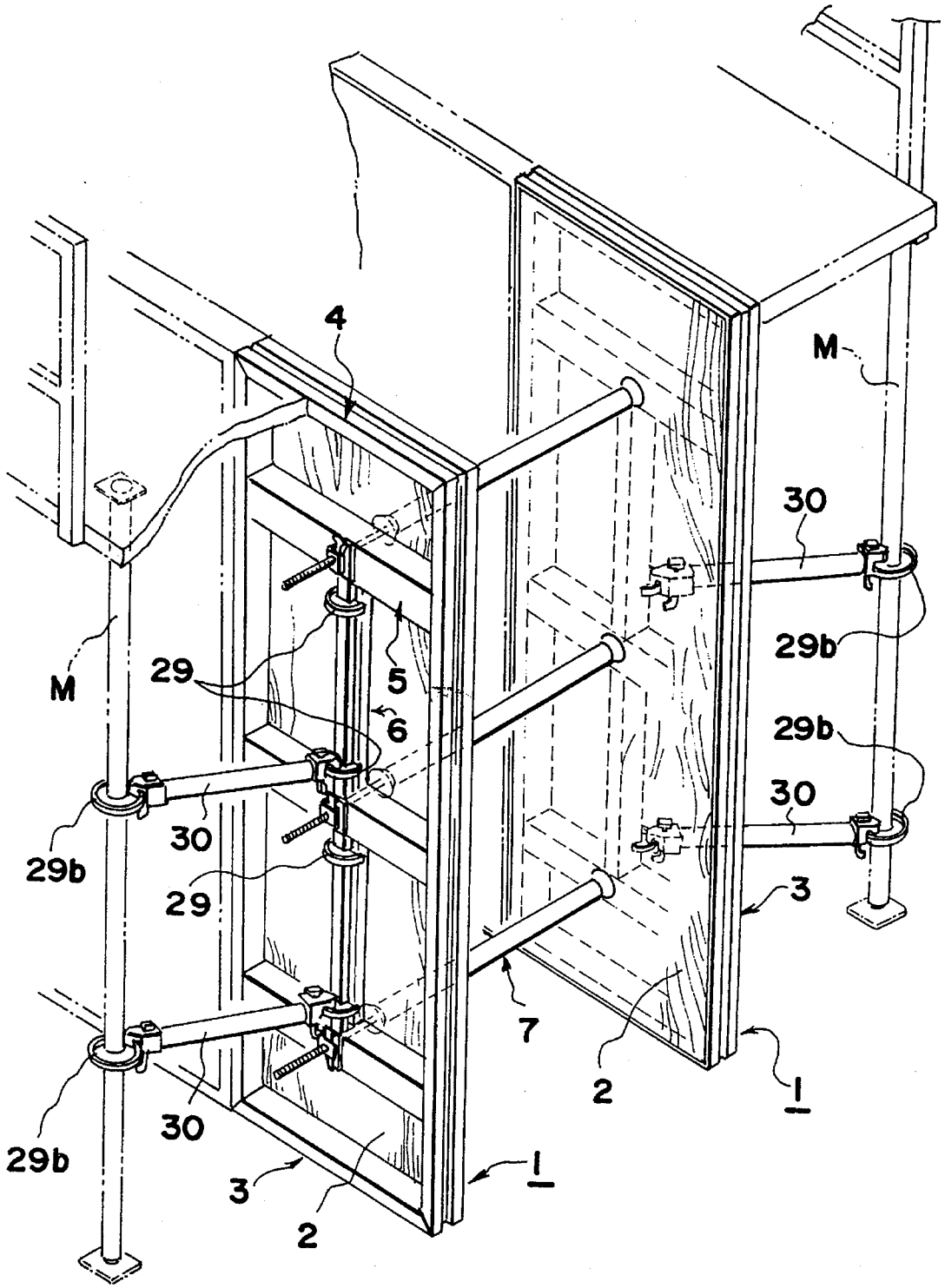
FIG. 9 is a perspective view showing an example of the form panel connected to supporting posts.

FIG. 9 shows an example of connection of the same form panels 1, 1 as those in FIG. 1 to the support posts M, M through the brake 30 and the flanges 29 and 29*b*. Their functions and advantages are the same as those previously described.

According to the present invention, the form panel has the following advantages.

1) Since the flat board and the reinforcing frame body can be jointed to the support post and a scaffolding frame for other work through a flange provided on the back side, the arrangement and support of the frame panel itself can be carried out at the same time when the posts and scaffolding frame are set up.

2) Similarly, since the frame panel and concrete load can be supported by other posts and scaffolding frames through a flange and a brace, it will become unnecessary to use a horizontal end rail and a vertical end rail for supporting the frame panel; therefore it is possible to reduce the number of component parts and accordingly to improve economics and to dispense with the installation and removal of the end rails, thereby improving working efficiency.

3) Similarly, since the frame panel and concrete load can be supported by other posts and scaffolding boards through a flange and a brace, it is possible to dispense with a clamp, a bolt, and a tightening member, thus improving economics and working efficiency.

4) Similarly, since the form panel and concrete load can be supported by other posts and scaffolding frame through a flange and a brace, it-is possible to use the form panel as a cantilever form.

5) The brace may be hooked and secured on the flange, and accordingly its positioning can easily be performed.

6) The scaffolding frame to be connected to the flange can also be used in the support, installation and removal of the form panel, and accordingly it will become unnecessary to set up another scaffolding frame, thus improving working efficiency and economics.

What is claimed is:

1. A form panel comprising:

a flat board having a front surface and a back surface opposite to said front surface;

a reinforcing frame body secured to said back surface of said flat board and having a surface facing in the same direction as said back surface of said flat board;

at least one flange disposed on said surface of said reinforcing frame body, said flange including a semi-circular frame body and a hooking part including a projection extending along a peripheral edge of said semi-circular frame body.

2. A form panel assembly comprising:

a flat board having a front surface and a back surface opposite to said front surface;

a reinforcing frame body secured to said back surface of said flat board and having a surface facing in the same direction as said back surface of said flat board;

at least one flange connected to said surface of said reinforcing frame body, said flange being a semi-circular flange body having an L-shaped cross section, said semi-circular flange body having a hook projection extending along a peripheral edge of said semi-circular flange body, said hook projection defining an engaging surface; and an engaging member with a brace connected to one of a support post and a scaffolding frame for connection to said flange.

3. A form panel assembly comprising:

a flat board having a front surface and a back surface opposite to said front surface;

a reinforcing frame body secured to said back surface of said flat board and having a surface facing in the same direction as said back surface of said flat board and including a plurality of horizontal rails, a vertical rail provided in a vertical direction between said horizontal rails, an outside frame provided at a periphery of said reinforcing body, said horizontal rails being provided on an inside of said outside frame, said outside frame having a pair of grooves formed in an axial direction, facing radially outwardly, said grooves being formed of a shaped material in an outside surface of said shaped material, said horizontal rails having at least a pair of horizontal rail grooves formed in an axial direction of said horizontal rail, said horizontal rail grooves facing radially outwardly, said horizontal rail grooves being formed of a shaped material in an outside surface of said shaped material, and insertion holes formed in a center of said horizontal rails and in said flat board for inserting a clamp, said vertical rail having a pair of vertical rail grooves formed in an axial direction of said vertical rail, facing radially outwardly, said vertical rail grooves being formed of a shaped material in an outside surface of said shaped material, at least one horizontal flange connected to said surface of said reinforcing frame body, said horizontal flange being a semi-circular flange body having an L-shaped cross section, said flange including a hook projection extending along a peripheral edge of said semi-circular flange body; and an engaging member with a brace connected to one of a support post and a scaffolding frame for connection to said horizontal flange.

4. A form panel as claimed in claim 1, wherein said reinforcing frame body comprises a plurality of horizontal rails provided adjacent to said flat board back surface, a vertical rail provided extending in a vertical direction between said horizontal rails and an outside frame provided at the periphery of said reinforcing frame body, said horizontal rails and said vertical rail having at least a pair of grooves formed in an axial direction, facing radially outwardly, said grooves being formed of a shaped material, and insertion holes formed in a center of said horizontal rails and in said flat board for insertion of a clamp.

5. A form panel assembly according to claim 2, further comprising flange attachment means for connecting said flange to said frame body, said flange attachment means including a clamp.

6. A form panel assembly according to claim 3, further comprising flange attachment means for connecting said flange to said frame body.

7. A form panel assembly according to claim 2, wherein said hook projection includes a portion substantially perpendicular to said flange and a portion substantially parallel to said flange.

* * * * *